US005935306A

United States Patent [19]

Reed

[11] Patent Number: 5,935,306

[45] Date of Patent: Aug. 10, 1999

[54] ELECTROLESS GOLD PLATING BATH

[75] Inventor: Allan H. Reed, Warwick, R.I.

[73] Assignee: Technic Inc., Cranston, R.I.

[21] Appl. No.: 09/021,638

[22] Filed: Feb. 10, 1998

[51] Int. Cl.[6] ..... C23C 18/44

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 3,700,469 | 10/1972 | Okinaka | 106/1 |
| 4,804,559 | 2/1989 | Ushio et al. | 427/96 |
| 4,880,464 | 11/1989 | Ushio et al. | 106/1.05 |
| 5,198,273 | 3/1993 | Ando et al. | 427/437 |
| 5,202,151 | 4/1993 | Ushio et al. | 427/98 |
| 5,232,492 | 8/1993 | Krulik et al. | 106/1.23 |
| 5,258,062 | 11/1993 | Nakawaza et al. | 106/1.23 |
| 5,318,621 | 6/1994 | Krulik et al. | 106/1.23 |
| 5,322,552 | 6/1994 | Dettke et al. | 106/1.23 |
| 5,364,460 | 11/1994 | Morimoto et al. | 106/1.23 |
| 5,470,381 | 11/1995 | Kato et al. | 106/1.23 |
| 5,660,619 | 8/1997 | Wachi et al. | 106/1.23 |

OTHER PUBLICATIONS

"Electroless Gold Plating Bath Using Ascorbic Acid as Reducing Agent—Recent Improvements", By M. Kato et al., Central Research Laboratory, Kanto Chemical Co., pp. 805–813, no date available.

*J. Electrochem. Soc.*, vol. 142, No. 7, Jul. 1995, "The Autocatalytic Deposition of Gold in Nonalkaline, Gold Thiosulfate Electroless Bath", By Anne M. Sullivan, et al., pp. 2250–2255.

*Plating & Surface Finishing*, "Electroless Gold Plating by Disulfiteaurate Complex", By H. Honma et al., Apr., 1995, pp. 89–92.

"Electroless Gold Deposition in a Non–Alkaline, Cyanide Free Bath", By Anne Sullivan et al., Electroless Session AESF SUR/FIN '94, pp. 595–603, month unavailable.

*J. Electrochem. Soc.*, vol. 144, No. 5, May 1997, "Electrochemical Study of the Gold Thiosulfate Reduction", By Anne M. Sullivan et al., pp. 1686–1690.

*Primary Examiner*—Helene Klemanski

*Attorney, Agent, or Firm*—Ernest V. Linek; Banner & Witcoff, Ltd.

[57] ABSTRACT

This invention relates generally to a solution for electroless deposition of gold, and more particularly to a cyanide-free electroless gold solution that can be replenished by the addition of a solution of a non-cyanide complex of gold. The operating temperature range for the plating solution of the present invention ranges from about 40° to about 70° C. The opportunity to deposit gold at such low operating temperatures is especially beneficial for plating devices which cannot withstand the higher temperatures required for existing electroless gold solutions. The relatively low operating temperatures also provide for significant energy savings and increased operator comfort and safety as compared to existing electroless gold solutions.

30 Claims, No Drawings

ELECTROLESS GOLD PLATING BATH

FIELD OF THE INVENTION

This invention relates generally to a solution for electroless deposition of gold, and more particularly to a cyanide-free electroless gold solution that can be replenished by the addition of a solution of a non-cyanide complex of gold.

BACKGROUND OF THE INVENTION

Gold has long been used in the electronics industry as a material for contact surfaces because of its low electrical resistivity and its inertness to attack by corrosive substances. Contact and connector surfaces of most electronic devices are usually electroplated with gold whenever reliability of the device is required. As the trend toward miniaturization of electronic devices and components continues, there is an increasing need within the industry for small, relatively thick, isolated gold deposits on printed wiring boards and integrated circuit chips. Typical thicknesses required for these deposits are in the range of 0.5 to 2 microns (20 to 80 microinches).

Applications of these deposits include pads for gold wire bonding as well as direct interconnection from one device to another. The fact that the areas where gold deposition is required are isolated from each other prevents electrolytic deposition of gold from being used to produce these deposits since the areas are not electrically connected to one another. Consequently, such deposits can be produced only by electroless deposition of gold.

Electroless deposition is a process by which a metal is deposited onto a surface by autocatalytic chemical reduction. Both a dissolved salt of the metal to be deposited, often in the form of a complex ion, and an appropriate reducing agent are dissolved in the plating solution. In order for such a solution to be of practical use, the reaction between dissolved metal species and the reducing agent must occur only on the surface areas where metal deposition is desired and not in the bulk of the solution. In order for thick deposits to be produced, the reaction between the dissolved metal species and the reducing agent must continue to occur on the surface of the deposited metal. Hence, electroless deposition is often referred to as autocatalytic deposition since the deposited metal acts as a catalytic surface for further deposition of the metal. A generally accepted indication that an electroless deposition process is truly autocatalytic is that its rate of deposition is more or less independent of thickness. That is, thickness of the deposited metal is linear with respect to deposition time at a given temperature.

Other aspects of an electroless plating solution which are of practical consequence—especially when producing electronic devices—are its operating pH and temperature. These must be compatible with other materials on the device such as photoresist when the device is immersed in the solution. If such materials are attacked by the electroless plating solution, deposition can occur on unwanted locations on the device. Consequently, it is most desirable that electroless solutions operate close to neutral pH and at a temperature as low as possible consistent with an adequate deposition rate.

There have been numerous attempts to produce workable electroless gold plating solutions. Many of these are described in reviews by Okinaka (Chapter 15 of "Electroless Plating: Fundamentals and Applications," edited by G. O. Mallory and J. B. Hajdu, American Electroplaters and Surface Finishers Society, 1990, and Chapter 2 of "Advances in Electrochemical Science and Engineering," volume 3, edited by H. Gerischer and C. W. Tobias, VCH Publishers, 1994).

A solution that has received wide attention is that described by Okinaka in U.S. Pat. No. 3,700,469. This solution contained a soluble gold cyanide complex along with excess cyanide and hydroxide ions and used an alkali metal borohydride or dimethylamine borane as the reducing agent. Its operating temperature was 60° to 95° C. Although much work has been reported on attempts to improve the performance of this formulation, it still suffers from two major problems. First, the reducing agent undergoes a hydrolysis reaction whose rate increases with temperature. Thus, much of the reducing agent is lost in an undesired side reaction making control of its concentration quite difficult if the bath is to be maintained at its operating temperature for a duration of several hours of longer. Second, the solution is subject to spontaneous decomposition whereby the dissolved gold is reduced homogeneously in the solution to produce a metallic gold sludge. No reported modifications of this solution have yet solved these problems in a practical manner. Even if a solution to these problems were found, the fact that the solution operates at a high pH and a high temperature would still render it incompatible with many materials used in present-day electronic packaging technology.

More recent efforts to develop autocatalytic gold deposition solutions that are both stable and compatible with materials that are used in the packaging of electronic devices have focused on the use of non-cyanide gold complexes which can be reduced in solutions of near-neutral pH. Examples of such gold complexes include gold (III) chloride (U.S. Pat. Nos. 5,198,273; 5,202,151; and 5,470,381), gold (I) thiosulfate (U.S. Pat. Nos. 4,804,559; 5,198,273; 5,202,151; 5,318,621; and 5,470,381), and gold (I) sulfite (U.S. Pat. Nos. 5,318,621; 5,364,460; and 5,470,381). Suitable reducing agents for these gold complexes include thiourea and its derivatives (U.S. Pat. Nos. 4,804,559; 4,880,464; 5,198,273; and 5,202,151), amine boranes or hydroquinone (U.S. Pat. No. 5,364,460), amino acids (U.S. Pat. No. 5,318,621), and ascorbic acid or a salt thereof (U.S. Pat. Nos. 5,364,460 and 5,470,381).

It has generally been found that the solutions described above are lacking in one or more features that would be desired of a solution for use in commercial production applications. For example, the solutions which use thiourea as a reducing agent must be heated as hot as 80° to 90° C. in order to achieve acceptable deposition rates. Such temperatures are too high for use with some electronics packaging materials. Also, at these temperatures the solutions can easily become unstable and spontaneously form fine particles of gold throughout the solution instead of producing gold deposits only on the desired substrate. When this occurs, the solution is said to "plate out" or "crash" and any further use of the solution is precluded. A common approach to eliminate or lessen the amount of plate-out that occurs in a solution is to add a stabilizer to the solution. The use of various stabilizer compounds in autocatalytic gold solutions is described, for example, in U.S. Pat. Nos. 5,364,460 and 5,470,381.

Another problem associated with the aforementioned electroless gold solutions is the difficulty in operating these solutions for extended periods of time while replenishing the ingredients that are depleted during deposition such as the gold complex, the reducing agent, and the stabilizer or stabilizers. If these ingredients are not maintained near their optimum concentrations, the solution will not operate satisfactorily. Either the deposition rate will decrease to an unacceptably slow rate if the gold complex or the reducing agent become depleted or the solution will spontaneously decompose if their concentrations are allowed to increase beyond certain limits. Likewise, if the stabilizer concentration becomes too high, the deposition rate of gold will diminish and if the stabilizer concentration becomes too low, the solution can spontaneously plate out. In many instances, it is difficult to control such solutions so that they can be used for several metal turnovers. A metal turnover is defined as the deposition of an amount of metal equal to that initially dissolved in the solution.

SUMMARY OF THE INVENTION

Cyanide-free electroless gold plating baths containing sulfite and thiosulfate as complexing agents and ascorbic acid as the reducing agent have been known since about 1989. See for example the paper entitled "Electroless Gold Plating Bath Using Ascorbic Acid as Reducing Agent—Recent Improvements," by Kato et al., [[Proceedings of AESF SUR/FIN '95, Session V, Baltimore (1995)]. As indicated therein, improvements to this general bath composition consist of the incorporation of suitable bath additives. The present invention represents yet another improvement of this technology. In the present invention, the bath generally comprises:

(a) sodium gold sulfite;

(b) sufficient alkali metal or ammonium thiosulfate to convert the sodium gold sulfite to a gold thiosulfate complex;

(c) ascorbic acid or a salt thereof as a reducing agent; and (d) a buffer for maintaining a pH of about 5 to 9.

In a preferred embodiment of the invention, potassium citrate is employed as the pH buffer and potassium thiosulfate provides the source of thiosulfate to form the gold-thiosulfate complex from the gold sulfite complex, as follows:

(a) 50 g/l tripotassium citrate monohydrate (b) 3.5 g/l potassium thiosulfate (c) 2.5 g/l ascorbic acid (d) 1.56 g/l gold as sodium gold sulfite A bath of this composition with a pH of 7.5 and a temperature of 120 to 130° F. produced gold deposits which had a thickness of 20 to 25 microinches in 30 minutes and a thickness of 35 to 40 microinches in 60 minutes. Thicker deposits were obtained with longer plating times. Deposition was truly autocatalytic since all deposits were plated onto immersion gold plated nickel and the thickness increased with increasing plating time.

The bath of the present invention has numerous advantages over previously known baths of this type. No excess quantities of sulfite are required and no stabilizers are necessary. Surprisingly it has been found that the use of potassium as the predominant cation helps to produce a high deposition rate. When the bath was formulated with sodium citrate, the deposition rate was about one-half of that obtained when potassium citrate was used. Likewise, potassium gold sulfite or potassium gold thiosulfate could be employed to enhance the cation effect on deposition rate.

The preferred bath composition is stable over periods of several weeks of usage, with only daily filtration required to remove small amounts of gold that form homogeneously in the solution. The preferred solution is replenished by the additions of gold as a solution of gold sulfite and ascorbic acid. Daily adjustment of pH is also necessary. The preferred bath has been successfully operated for more than three metal turnovers. A metal turnover means that an amount of metal equal to that in the initial solution has been deposited from the solution.

Accordingly, one object of the present invention is to provide a stable electroless gold plating solution in which the gold is introduced as a sulfite complex. Another object of the present invention is to provide an electroless gold plating solution whose operating temperature and pH will allow its use with materials used in microelectronics packaging.

Yet another object of this invention is to provide an electroless gold plating solution that can be operated for multiple metal turnovers without decomposition.

DETAILED DESCRIPTION OF THE PREFERRED EMBODIMENTS

During the course of investigating various non-cyanide electroless gold solutions such as those described above that might be compatible with materials used for microelectronics packaging, it was found that the existing solutions suffered from either instability or low deposition rate, and often from both. These investigations showed that the stability could be increased by operating at temperatures lower than usually reported for such solutions.

Another discovery was that the use of stabilizers and the relatively high concentration of reducing agent, as disclosed in U.S. Pat. No. 5,470,381, could be eliminated when operating at lower temperatures. It is hypothesized that stabilizers acts by adsorbing on the surface of colloidal gold particles which form in the bulk of the solution and act as sites for further electroless deposition in the solution and ultimately lead to bath decomposition. By adsorbing on the surface of the gold particles in solution when they are first formed, the stabilizers block further gold deposition on the particles, and thereby prevent bath decomposition. However, since the stabilizers adsorb on all gold surfaces, they also adsorb on the gold deposits on the areas where deposition is desired and decrease the overall deposition rate of the solution. Therefore, a high concentration of reducing agent is required to overcome the preferential adsorption of stabilizer on the surfaces to be plated. Thus, the balance between the concentrations of stabilizer and reducing agent becomes critical to proper functioning of the electroless plating solution. While the foregoing mechanism has not been verified, the solution disclosed in this invention overcomes the need to balance the concentrations of stabilizer and reducing agent by eliminating the need for a stabilizer. Finally, it was discovered that the presence of high concentrations of an alkali metal or ammonium sulfite or thiosulfate also decreased the deposition rate of the solution.

It is known from fundamental electrochemical polarization measurements that gold is more easily reduced from its thiosulfate complex than from its sulfite complex. Furthermore, the stability constant of the gold thiosulfate complex is several orders of magnitude greater than that of the gold sulfite complex. Finally, an excess of either thiosulfate or sulfite anions increases the polarization for gold deposition from either of these complexes. Thus, the optimum solution for electroless gold deposition should contain gold as the thiosulfate complex with no significant excess of thiosulfate or sulfite.

From a practical standpoint, the gold sulfite complex is commercially available as an aqueous solution of sodium gold sulfite ($Na_3Au(SO_3)_2$. One such commercial solution is known as Techni-Gold® 25 (supplied by Technic, Inc.) which contains two (2) troy ounces of gold per liter of solution. This product provides a convenient source of gold for preparing and replenishing an electroless gold solution. The addition of a suitable amount of an alkali metal or ammonium thiosulfate will convert the gold sulfite complex to the gold thiosulfate complex, which is more easily reduced. Thus the present invention provides an electroless gold plating solution containing (1) gold added as a solution of sodium gold sulfite; (2) an alkali metal or ammonium thiosulfate to convert the gold sulfite complex to the gold thiosulfate complex; (3) a reducing agent introduced as ascorbic acid or a salt thereof; and (4) a suitable pH buffer. Alternatively, the gold could be added directly as the thiosulfate complex so that only the reducing agent and the pH buffer would be required to complete the solution.

A preferred embodiment of the electroless gold solution of the present invention is as follows: The solution will contain 0.001 to 0.01 moles/liter of gold added as a solution of sodium gold sulfite, 0.002 to 0.10 moles/liter of sodium thiosulfate or potassium thiosulfate, 0.005 to 0.10 moles/liter of ascorbic acid or its sodium salt, and a pH buffer.

The effects of varying the concentrations of the above-mentioned ingredients on plating rate and solution stability were studied, with the following findings:

(1) Sodium gold sulfite is used in a concentration preferably from 0.002 to 0.10 moles/liter and especially preferably from 0.005 to 0.05 moles/liter. When the concentration of gold is less than 0.002 moles/liter, no significant deposition occurs and when the concentration of gold is greater than 0.10 moles/liter, the solution tends to plate out gold homogeneously throughout the bulk of the solution;

(2) The thiosulfate concentration should be present at twice the concentration of gold in order to convert the gold sulfite complex into the gold thiosulfate complex according to the reaction:

$$Au(SO_3)_2^{-3}+2S_2O_3^{-2}\rightarrow Au(S_2O_3)_2^{-3}+2SO_3^{-2}.$$

When gold is deposited from the solution, the thiosulfate is left behind and becomes available to convert replenishment additions of the gold sulfite complex to the gold thiosulfate complex. It has been found that concentrations of thiosulfate greater than twice the gold concentration have no significant effect on the performance of the solution;

(3) Ascorbic acid or its salt is used in a concentration preferably from 0.005 to 0.10 moles/liter and especially preferably from 0.01 to 0.05 moles/liter. When the concentration of ascorbic acid or its salt is less than 0.005 moles/liter, no significant deposition occurs and when the concentration of ascorbic acid or its salt is greater than 0.10 moles/liter, the solution tends to plate out gold throughout the bulk of the solution.

A preferred example of the pH buffer is prepared using an alkali metal salt of citric acid and an alkali metal hydroxide. Alternatively, the buffer solution can be prepared directly from citric acid and an alkali metal hydroxide. The concentration of buffer salt is preferably 0.01 to 1.0 moles/liter and especially preferably from 0.05 to 0.5 moles/liter. At a concentration less than 0.10 moles/liter, the buffering capacity is too low to prevent the pH of the solution from decreasing rapidly during deposition of gold, which can lead to decomposition of the solution. No benefit to the solution performance can be expected by increasing the buffer salt concentration beyond 1.0 moles/liter. The preferred pH range is 5 to 9 and especially preferably 6 to 8.

Any alkali metal or ammonium salt of citric acid can be used to prepare the pH buffer used in this invention. However, the potassium salt is greatly preferred since electroless gold solutions with this salt as the buffer show an unexpectedly greater gold deposition rate than otherwise identical solutions prepared with the sodium salt of citric acid as the buffer salt. This surprising result is illustrated in Examples 1 and 2 below.

The operating temperature range for the plating solution of the present invention may be from 40° to 70° C., preferably from 45° to 65° C., and more preferably from 50° to 55° C. The opportunity to deposit gold at these low operating temperatures is especially beneficial for plating devices which cannot withstand the higher temperatures required for existing electroless gold solutions. The relatively low operating temperatures also provide for significant energy savings and increased operator comfort and safety as compared to existing electroless gold solutions.

EXAMPLES

The following examples illustrate various implementations of the present invention but are not meant to limit the manner in which the invention may be practiced.

Example 1

An electroless gold plating solution (A) having the composition described below was used to deposit electroless gold onto a copper coupon which was prepared by first depositing approximately 100 microinches of electroless nickel followed by 4 to 5 microinches of immersion gold. Only the bottom half of the coupon was immersed in the electroless gold solution so that the thickness of both the immersion gold and the total gold thickness could be measured by x-ray fluorescence. By using this technique, the thickness of the electroless gold deposit could be determined as the difference between the thicknesses of the two different areas on the coupon. After 30 minutes deposition time in the electroless gold solution (A) at a temperature of 67° C., the thickness of gold due to electroless deposition was 22 microinches.

| Electroless Gold Deposition Solution (A) | |
|---|---|
| Sodium Citrate | 45 g/l |
| Sodium Thiosulfate Pentahydrate | 5 g/l |
| Sodium Ascorbate | 10 g/l |
| Gold, as Sodium Gold Sulfite | 1.9 g/l |
| pH | 6.5 |

Example 2

An electroless gold solution (B) having the composition described below was used to deposit electroless gold on a coupon prepared in the manner described in Example 1. After 30 minutes deposition time in the electroless gold solution (B) at a temperature of 67° C., the thickness of gold due to electroless deposition was 74 microinches.

| Electroless Gold Deposition Solution (B) | |
|---|---|
| Potassium Citrate | 50 g/l |
| Sodium Thiosulfate Pentahydrate | 5 g/l |
| Sodium Ascorbate | 10 g/l |
| Gold, as Sodium Gold Sulfite | 1.9 g/l |
| pH | 6.5 |

Example 3

An electroless gold solution having the same composition as that of solution (B) in example 2 except that the pH of the solution adjusted to 7.5 was used to deposit electroless gold onto two coupons in the manner described in example 1. The thickness of the electroless gold deposit on the first coupon after 30 minutes deposition time was 29 microinches. The thickness of the electroless gold on the second coupon after 60 minutes of deposition time was 52 microinches. The temperature of the electroless gold solution was 54° C.

Example 4

An electroless gold solution (C) having the composition described below was used to deposit electroless gold on two coupons prepared as described in Example 1. The temperature of the solution was 49° C. The thickness of electroless gold on the first coupon after 30 minutes deposition time was 25 microinches. The thickness of electroless gold on the second coupon after 60 minutes deposition time was 50 microinches.

| Electroless Gold Deposition Solution (C) | |
|---|---|
| Potassium Citrate | 50 g/l |
| Sodium Thiosulfate Pentahydrate | 5 g/l |
| Sodium Ascorbate | 5 g/l |
| Gold, as Sodium Gold Sulfite | 1.6 g/l |
| pH | 7.5 |

Example 5

Three electroless gold plating solutions (D) having the compositions described below were used to deposit electroless gold on coupons prepared as described in Example 1. The temperature of all three solutions was 52° C. The solutions differed only in their concentration of sodium ascorbate. The thickness of electroless gold from each solution after 30 minutes deposition time are shown in Table 1.

| Electroless Gold Plating Solutions (D) | 1 | 2 | 3 |
|---|---|---|---|
| Potassium Citrate | 50 g/l | 50 g/l | 50 g/l |
| Sodium Thiosulfate Pentahydrate | 5 g/l | 5 g/l | 5 g/l |
| Sodium Ascorbate | 1.5 g/l | 2.25 g/l | 3.0 g/l |
| Gold, as Sodium Gold Sulfite | 1.6 g/l | 1.6 g/l | 1.6 g/l |
| pH | 7.5 | 7.5 | 7.5 |

TABLE 1

| Concentration of Sodium Ascorbate | Electroless Gold Thickness After 30 Minutes |
|---|---|
| 1.5 g/l | 16 Microinches |
| 2.25 g/l | 23 Microinches |
| 3.0 g/l | 22 Microinches |

Example 6

An electroless gold plating solution (E) having the composition described below was used to deposit electroless gold on a series of coupons over the course of several days. The coupons were prepared as described in Example 1. After each coupon was plated, the gold concentration in the solution was replenished by addition of sodium gold sulfite. Ascorbic acid was replenished and the pH of the solution was adjusted periodically. The solution temperature was maintained between 50° and 54° C. while plating and allowed to cool to room temperature overnight. At the end of each day, the solution was filtered through fast filter paper to remove any gold deposits that might have formed during the day. At no time during the plating of this series of coupons was any solution decomposition observed. The thickness of the electroless gold deposited in 60 minutes over the course of operation of this solution and cumulative percentage of gold replenished are shown in Table 2. The initial plating rate of the solution was approximately 40 microinches per hour. It is important to note from Table 2 that the deposition rate could be restored by replenishment of ascorbic acid. Furthermore, the cessation of this series of coupons was done arbitrarily and was not due to any deficiency in solution performance. Therefore, it is anticipated that deposition from the solution with continued replenishment of both gold and ascorbic acid could have continued successfully for at least one and possibly two more metal turnovers before the performance of the solution would have deteriorated below an acceptable level.

| Electroless Gold Deposition Solution (E) | |
|---|---|
| Potassium Citrate | 50 g/l |
| Potassium Thiosulfate | 3.5 g/l |
| Ascorbic Acid | 2.5 g/l |
| Gold, as Sodium Gold Sulfite | 1.6 g/l |
| pH | 7.5 |

TABLE 2

| Cumulative Percent of Initial Gold Concentration Consumed and Replenished | Thickness of Electroless Gold Deposited in 60 Minutes, Microinches |
|---|---|
| 35 | 39 |
| 50 | 37(A) |
| 74 | 42 |
| 90 | 40 |
| 102 | 36(A) |
| 117 | 39 |
| 131 | 38 |
| 145 | 40 |
| 159 | 39 |
| 173 | 36 |
| 184 | 33 |
| 195 | 29(B) |
| 209 | 35 |
| 222 | 36 |

(A) Added 0.36 g/l Ascorbic Acid to the Solution.
(B) Added 0.43 g/l Ascorbic Acid to the Solution.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. An electroless gold plating solution consisting essentially of:

(a) sodium gold sulfite;

(b) from about 0.002 to about 0.10 moles/liter alkali metal or ammonium thiosulfate;

(c) from about 0.005 to about 0.10 moles/liter ascorbic acid or a salt thereof; and (d) a buffer for maintaining a pH of about 5 to 9.

2. The gold plating solution of claim 1, wherein the concentration of the sodium gold sulfite ranges from about 0.001 to 0.01 moles/liter.

3. The gold plating solution of claim 1, wherein the concentration of the sodium gold sulfite ranges from about 0.002 to 0.10 moles/liter.

4. The gold plating solution of claim 1, wherein the concentration of the sodium gold sulfite ranges from about 0.005 to 0.05 moles/liter.

5. The gold plating solution of claim 1, wherein the concentration of the alkali metal thiosulfate ranges from about 0.002 to 0.10 moles/liter.

6. The gold plating solution of claim 5, wherein the alkali metal thiosulfate is sodium thiosulfate.

7. The gold plating solution of claim 5, wherein the alkali metal thiosulfate is potassium thiosulfate.

8. The gold plating solution of claim 1, wherein the concentration of the sodium salt of ascorbic acid ranges from about 0.005 to 0.10 moles/liter.

9. The gold plating solution of claim 1, wherein the concentration of the thiosulfate is about twice the concentration of gold.

10. The gold plating solution of claim 9, wherein the concentration of the ascorbic acid ranges from about 0.005 to 0.10 moles/liter.

11. The gold plating solution of claim 1, wherein the concentration of the ascorbic acid ranges from about 0.01 to 0.05 moles/liter.

12. The gold plating solution of claim 1, wherein the pH buffer comprises an alkali metal salt of citric acid and an alkali metal hydroxide.

13. The gold plating solution of claim 1, wherein the pH buffer comprises citric acid and an alkali metal hydroxide.

14. The gold plating solution of claim 1, wherein the concentration of buffer salt is from about 0.01 to 1.0 moles/liter.

15. The gold plating solution of claim 1, wherein the concentration of buffer salt is from about 0.05 to 0.5 moles/liter.

16. The gold plating solution of claim 15, wherein the pH of the solution ranges from about 6 to 8.

17. The gold plating solution of claim 1, wherein the pH of the solution ranges from about 6.5 to 7.5.

18. The gold plating solution of claim 1, wherein the pH buffer comprises an alkali metal or ammonium salt of citric acid.

19. The gold plating solution of claim 1, wherein the pH buffer comprises the potassium salt of citric acid.

20. The gold plating solution of claim 1, wherein the operating temperature range is from about 40° to 70° C.

21. The gold plating solution of claim 1, wherein the operating temperature range is from about 45° to 65° C.

22. The gold plating solution of claim 1, wherein the operating temperature range is from about 50° to 55° C.

23. An electroless gold plating solution having a pH of 6.5 consisting essentially of:

(a) 50 g/l potassium citrate;

(b) 3.5 g/l potassium thiosulfate;

(c) 2.5 g/l ascorbic acid; and (d) 1.6 g/l of gold, added as sodium gold sulfite.

24. An electroless gold plating solution having a pH of 6.5 consisting essentially of:

(a) 50 g/l potassium citrate;

(b) 5 g/l sodium thiosulfate pentahydrate;

(c) 10 g/l sodium ascorbate; and (d) 1.9 g/l of gold, added as sodium gold sulfite.

25. An electroless gold plating solution having a pH of 7.5 consisting essentially of:

(a) 50 g/l potassium citrate:

(b) 5 g/l sodium thiosulfate pentahydrate;

(c) 5 g/l sodium ascorbate; and (d) 1.6 g/l of gold, added as sodium gold sulfite.

26. An electroless gold plating solution having a pH of 7.5 consisting essentially of:

(a) 50 g/l potassium citrate;

(b) 5 g/l sodium thiosulfate pentahydrate;

(c) 1.5 g/l sodium ascorbate; and (d) 1.6 g/l gold, added as sodium gold sulfite.

27. An electroless gold plating solution having a pH of 7.5 consisting essentially of:

(a) 50 g/l potassium citrate;

(b) 5 g/l sodium thiosulfate pentahydrate;

(c) 2.25 g/l sodium ascorbate; and (d) 1.6 g/l gold, added as sodium gold sulfite.

28. An electroless gold plating solution having a pH of 7.5 consisting essentially of:

(a) 50 g/l potassium citrate;

(b) 5 g/l sodium thiosulfate pentahydrate;

(c) 3.0 g/l sodium ascorbate; and (d) 1.6 g/l gold, added as sodium gold sulfite.

29. An electroless gold plating solution having a pH of 7.5 consisting essentially of:

(a) 50 g/l potassium citrate;

(b) 3.5 g/l potassium thiosulfate (c) 2.5 g/l ascorbic acid; and (d) 1.6 g/l gold, added as sodium gold sulfite.

30. An electroless gold plating solution having a pH of 6.5 consisting essentially of:

(a) 45 g/l sodium citrate;

(b) 5 g/l sodium thiosulfate;

(c) 10 g/l sodium ascorbate; and (d) 1.9 g/l gold, added as sodium gold sulfite.

* * * * *